US009045314B2

(12) United States Patent
Finschi

(10) Patent No.: US 9,045,314 B2
(45) Date of Patent: Jun. 2, 2015

(54) METHOD FOR ENABLING THE USE OF AN ELEVATOR SYSTEM BY DISABLED PERSONS USING POSITION CHANGES, AND AN ELEVATOR SYSTEM

(75) Inventor: Lukas Finschi, Ebikon (CH)

(73) Assignee: Inventio AG, Hergiswil NW (CH)

( * ) Notice: Subject to any disclaimer, the term of this patent is extended or adjusted under 35 U.S.C. 154(b) by 999 days.

(21) Appl. No.: 13/133,991

(22) PCT Filed: Dec. 11, 2009

(86) PCT No.: PCT/EP2009/066883

§ 371 (c)(1),
(2), (4) Date: Aug. 26, 2011

(87) PCT Pub. No.: WO2010/066866

PCT Pub. Date: Jun. 17, 2010

(65) Prior Publication Data

US 2012/0168262 A1 Jul. 5, 2012

(30) Foreign Application Priority Data

Dec. 11, 2008 (EP) ..... 08171274

(51) Int. Cl.
*B66B 1/34* (2006.01)
*B66B 1/46* (2006.01)

(52) U.S. Cl.
CPC ..... *B66B 1/468* (2013.01); *B66B 1/467* (2013.01); *B66B 2201/4615* (2013.01); *B66B 2201/463* (2013.01); *B66B 2201/4638* (2013.01); *B66B 2201/4669* (2013.01)

(58) Field of Classification Search
CPC B66B 1/467; B66B 1/468; B66B 2201/4615; B66B 2201/463; B66B 2201/4638; B66B 2201/4669
USPC ..... 187/247, 248, 380–388, 391–393, 396, 187/901
See application file for complete search history.

(56) References Cited

U.S. PATENT DOCUMENTS

| | | | | |
|---|---|---|---|---|
| 5,192,836 | A * | 3/1993 | Schroder | 187/384 |
| 5,323,470 | A | 6/1994 | Kara | |
| 6,161,654 | A * | 12/2000 | Sirigu et al. | 187/391 |
| 6,161,655 | A | 12/2000 | Lejon | |
| 6,386,325 | B1 * | 5/2002 | Fujita | 187/316 |
| 6,828,918 | B2 * | 12/2004 | Bowman et al. | 340/4.1 |
| 6,902,041 | B2 * | 6/2005 | Eccleston | 187/380 |
| 6,942,068 | B2 * | 9/2005 | Tsukamoto et al. | 187/391 |
| 6,986,408 | B2 * | 1/2006 | Takeuchi | 187/380 |

(Continued)

FOREIGN PATENT DOCUMENTS

| | | |
|---|---|---|
| EP | 1110899 | 6/2001 |
| JP | 11 268879 | 10/1999 |
| JP | 2000 211833 | 8/2000 |

*Primary Examiner* — Anthony Salata
(74) *Attorney, Agent, or Firm* — Stroock & Stroock & Lavan LLP

(57) ABSTRACT

A method for enabling the use of an elevator system by disabled persons includes detecting at least one position change of a user using at least one sensor, said position change being in the form of at least one signal and at least one reference signal. The signal is then compared to the reference signal. At lease one signal status change is generated when at least one predefined comparison result is fulfilled. For the generated signal state change, the elevator system is at least partially brought to an operating mode enabling the use thereof by disabled persons.

27 Claims, 7 Drawing Sheets

(56) References Cited

U.S. PATENT DOCUMENTS

| | | | | |
|---|---|---|---|---|
| 7,031,525 | B2 * | 4/2006 | Beardsley | 382/199 |
| 7,043,084 | B2 * | 5/2006 | Beardsley | 382/224 |
| 7,079,669 | B2 * | 7/2006 | Hashimoto et al. | 382/118 |
| 7,142,694 | B2 * | 11/2006 | Hashimoto et al. | 382/106 |
| 7,164,784 | B2 * | 1/2007 | Beardsley | 382/154 |
| 7,207,422 | B2 * | 4/2007 | Takeuchi | 187/391 |
| 7,377,364 | B2 * | 5/2008 | Tyni et al. | 187/380 |
| 7,451,937 | B2 * | 11/2008 | Flood et al. | 236/94 |
| 7,496,445 | B2 * | 2/2009 | Mohsini et al. | 701/434 |
| 8,505,693 | B2 * | 8/2013 | Koba | 187/387 |
| 2002/0191819 | A1 | 12/2002 | Hashimoto | |
| 2004/0022439 | A1 | 2/2004 | Beardsley | |
| 2005/0252723 | A1 * | 11/2005 | Takeuchi | 187/380 |
| 2006/0011419 | A1 | 1/2006 | Chuang | |
| 2012/0175192 | A1 * | 7/2012 | Tsou | 187/247 |
| 2012/0234631 | A1 * | 9/2012 | Hsieh | 187/247 |
| 2014/0014444 | A1 * | 1/2014 | Kauppinen et al. | 187/389 |
| 2014/0094997 | A1 * | 4/2014 | Hyde et al. | 701/2 |

* cited by examiner

| | | | |
|---|---|---|---|
| 1 | CALL INPUT APPARATUS | 10 | ELEVATOR DRIVE |
| 4 | DESTINATION CALL CONTROLLER | 11 | FLOOR DOOR |
| 5 | ELEVATOR CONTROLLER | 12 | CABIN DOOR |
| 6 | ELEVATOR CABIN | 17 | SENSOR |
| 7 | COUNTERWEIGHT | S1-S3 | FLOORS |
| 9 | DOOR DRIVE | S4 | ELEVATOR SHAFT |

1 Call Input Apparatus
5 Elevator Controller
6 Elevator Cabin
7 Counterweight
9 Door Drive
10 Elevator Drive
11 Floor Door
12 Cabin Door
17 Sensor

S2

1 Call Input Apparatus
13 Input/Output Unit
16 Functional Descriptor
19 Radio Sensor
20 Mobile Communication Unit 1 Call Input Apparatus
13 Input/Output Unit
16 Functional Descriptor
17 Sensor 1 Call Input Apparatus
13 Input/Output Unit
16 Functional Descriptor
17 Sensor

METHOD FOR ENABLING THE USE OF AN ELEVATOR SYSTEM BY DISABLED PERSONS USING POSITION CHANGES, AND AN ELEVATOR SYSTEM

FIELD

The disclosure relates to adapting an elevator system for use by handicapped persons.

BACKGROUND

It is known that an elevator system having an elevator cabin transports users between floors of a building. To this end, the floors and/or the elevator cabin is/are provided with call input apparatuses which the users can use to make call inputs. On the basis of the call inputs, an elevator controller actuates an elevator drive for the elevator cabin and a door drive for the elevator cabin such that the users can enter the elevator cabin and are transported by the elevator cabin between floors of the building.

To provide for equality of users with handicaps, European standard 81-70 prescribes a handicapped persons pushbutton for the call input. Pushing the handicapped persons pushbutton puts the elevator system into a special mode of operation. In this special mode of operation, elevator doors on the floors and/or elevator cabins are open and/or closed more slowly and users with handicaps are provided with feedback from the call input by means of visual and/or audible signals.

The document US 2002/0191819 A1 describes a way of detecting elevator users using a wheelchair. This involves taking images of elevator users in the space in front of an elevator system and using the position of the face to infer a wheelchair user.

The document US 2004/0022439 A1 describes a method for distinguishing between people who are able to walk and people using a wheelchair. Images are used to ascertain a 3D model of a recorded person and to determine whether or not the person is a person with a wheelchair.

The document JP 2002211833 discloses a method for verifying a wheelchair user when the latter has pushed a special key on an elevator control unit. Pushing the special key indicates to the elevator system that the passenger is a wheelchair user. When the special key has been pushed, the person who has pushed the switch has an image taken by means of a camera, and it is verified whether the person is actually a wheelchair user.

The document JP 11268879 describes how disabled people are detected by means of two cameras as soon as they push a switch on an elevator control unit and how the elevator system executes the elevator journey in a special mode when a disabled person has been detected.

The document U.S. Pat. No. 5,192,836 describes how the elevator which executes a journey requested by a disabled person is selected from a group of elevators. In order to indicate that the person requesting the elevator journey is a disabled person, the requesting person pushes an additional key on the control unit of the elevator system.

The document U.S. Pat. No. 5,323,470 describes a method for tracking the face of a patient in real time using cameras so that a patient can be fed by a robot.

The document US 2006/0011419 A1 discloses how an elevator control unit has an arrangement of switching keys with an optical sensor which are able to be activated contactlessly.

The document U.S. Pat. No. 6,161,655 describes an elevator control switch which can be operated contactlessly. Infrared radiation is emitted by the switch. If a potential passenger keeps his hand in front of the elevator control switch, the infrared radiation is reflected and hence the switch is activated.

The specification EP1598298A1 shows an elevator system having a call input apparatus in the elevator cabin. The call input apparatus has a touch screen, which touch screen is not compliant with EN81-70, since it does not have a handicapped persons pushbutton. As a solution which is compliant with EN81-70, EP 1598298A1 discloses adding a handicapped persons pushbutton to the touch screen. A top side of the handicapped persons pushbutton is clearly recognizable to visually handicapped persons by virtue of Braille characters with a relief height of at least 0.8 mm. Pushing the handicapped persons pushbutton with a pushing force of between 2.5 N and 5.0 N operates an area of the screen below the handicapped persons pushbutton and generates a cabin call.

SUMMARY

In at least some embodiments disclosed herein, the elevator system can be put into a handicapped persons mode of operation while largely avoiding touching operator control elements and in which call inputs are also possible while largely avoiding touching operator control elements.

In further embodiments, at least one sensor detects at least one change of position by a user as at least one signal and at least one reference signal; the signal is compared with the reference signal; if at least one predefined comparison result is achieved then at least one signal state change is produced; and the elevator system is at least to some extent put into a handicapped persons mode of operation when the reference state change has been produced.

At least some embodiments are based on the insight that the user can produce a signal state change interactively and contactlessly solely by changing his position, which signal state change transfers the elevator system from a normal mode to a handicapped persons mode of operation. "Change of position" by the user is understood to mean any type of movement and/or rest by the user, which movement and/or rest can be detected as a signal and a reference signal by the sensor. The extent of the movement and/or rest can vary within the range of prescribed physical and/or time-based limits. Hence, a signal and a reference signal from a user are detected and the handicapped user can thereby express his desire to be moved by the elevator system in a handicapped persons mode of operation; he is therefore more easily able to take part in social life, to make social contacts, to train and do further studies and to undertake gainful employment.

Possibly, the reference signal is detected at a time before or after the signal. Possibly, a predefined comparison result is achieved if the detected signal matches the reference signal. Possibly, a predefined comparison result is achieved if the detected signal does not match the reference signal.

This can mean that a change of position by the user is detected by explicit signals. For each unit of time, a signal or reference signal is detected. There are multiple options in this context. By way of example, a user is detected by the sensor with a positive signal; the detected positive signal is compared with a detected negative signal as a reference signal. If these two successively detected signals do not match, a signal state change is produced. Alternatively, it is possible for a user resting in front of the sensor for a certain period of time to be detected as a series of negative signals. In this case, the detected series of negative signals is compared with a previously detected series of negative signals as a reference signal, and a match between the series of signals produces a signal state change. This can mean that only such a change of position by the user is used as a predefined comparison result for the signal and the reference signal, which change of position conveys the actual desire by the user. Such a change of position by the user is understood widely and can be learned intuitively.

Possibly, the signal and the reference signal are transmitted from the sensor to at least one apparatus, which apparatus is a destination call controller and/or elevator controller and/or call input apparatus; the apparatus compares whether the signal matches the reference signal; if the signal does match the reference signal then the signal state change is produced or if the signal does not match the reference signal then the signal state change is produced.

This can mean that the signal comparison and the production of the signal state change can be performed at a plurality of locations of the elevator system or by different apparatuses in the elevator system, which prompts a high level of flexibility for the implementation of the method.

Possibly, the elevator system is at least to some extent put into the handicapped persons mode of operation by the apparatus for a predetermined period of time when the signal state change has been produced. Possibly, the elevator system is at least to some extent put into the handicapped persons mode of operation by the apparatus for a predetermined period of time until at least one call from the user has been handled completely when the signal state change has been produced. Possibly, the elevator system is at least to some extent put into the handicapped persons mode of operation by the apparatus for a predetermined period of time until at least one call from the user has been handled completely when the signal state change has been produced.

This can mean that once the elevator system has been put into the handicapped persons mode of operation, the handicapped user can generate a call which is handled by the elevator system in the handicapped persons mode of operation. The change by the elevator system to the handicapped persons mode of operation can take place in part, i.e. only a portion of the elevator system is put into the handicapped persons mode of operation. First, in some embodiments, only one call input apparatus and/or only one elevator cabin can be put into the handicapped persons mode of operation. It is also possible for different portions of the elevator system to be put into the handicapped persons mode of operation at different times. Thus, first a call input apparatus and then an elevator cabin can be put into the handicapped persons mode of operation. By way of example, the call input apparatus is put into the handicapped persons mode of operation until a call has been input, and the elevator cabin assigned to the call is put into the handicapped persons mode of operation until the call has been handled completely. It is also possible for different portions of the elevator system to be put into the handicapped persons mode of operation for particular periods of time only. By way of example, an elevator cabin is put into the handicapped persons mode of operation only specifically while a cabin door is closing, and in this context an elevator door is closed with a particularly long delay and/or is closed particularly slowly after the passenger has entered the elevator cabin; in the rest of the period in which the passenger is traveling, the elevator cabin is not in the handicapped persons mode of operation.

Possibly, the signal state change produced indicates that a user can move and/or orient himself only using at least one facility specific to disabled persons. Possibly, the signal state change produced indicates that a user can move and/or orient himself only using at least one facility specific to disabled persons; which facility specific to disabled persons is a wheelchair and/or a hospital bed on castors and/or a crutch and/or a hearing aid and/or a visual aid and/or a white stick and/or a guide dog and/or an accompanying user.

This can mean that the handicapped user can indicate that he can move and/or orient himself in a building and hence also in the elevator system only using a facility specific to disabled persons.

Possibly, the signal state change produced indicates that a user can move and/or orient himself only using at least one facility specific to disabled persons; and that for a user with at least one facility specific to disabled persons, at least one elevator door is closed with a particularly long delay and/or is closed particularly slowly.

This can mean that the user who can move and/or orient himself only using at least one facility specific to disabled persons has sufficient time to enter and/or leave the elevator cabin.

Possibly, the signal state change produced indicates that a user can move and/or orient himself only using at least one facility specific to disabled persons; and that for a user with at least one facility specific to disabled persons, at least one elevator cabin is stopped on a floor with a particular degree of precision.

This can mean that the user who can move and/or orient himself only using at least one facility specific to disabled persons can enter and/or leave the elevator cabin on a level path.

Possibly, the signal state change produced indicates that a user can move and/or orient himself only using at least one facility specific to disabled persons; and that a user with at least one facility specific to disabled persons is allocated a particularly large amount of space in at least one elevator cabin.

This can mean that the user who can move and/or orient himself only using at least one facility specific to disabled persons has a large amount of space for his facility specific to disabled persons.

Possibly, the signal state change produced indicates that a user can move only using at least one facility specific to disabled persons; and that a user with at least one facility specific to disabled persons is transported by at least one elevator cabin from a call input floor to a destination floor.

This can mean that the user who can move using at least one facility specific to disabled persons is conveyed directly from the call input floor and therefore does not have to take any additional routes to a starting floor.

Possibly, the signal state change produced indicates that a user can move only using at least one facility specific to personal protection. Possibly, the signal state change produced indicates that a user can move only using at least one facility specific to personal protection; which facility specific to personal protection is a physical safe area and/or a time-based safe area and/or a bodyguard.

This can mean that even when a user in need of protection, i.e. a user with a potential safety threat, is conveyed by means of the elevator cabin in the building, it can be possible to ensure personal protection for the user against attacks from third parties.

Possibly, the signal state change produced indicates that a user can move only using at least one facility specific to personal protection; and that a user with at least one facility specific to personal protection is allocated a particularly large amount of space in at least one elevator cabin.

This can mean that the user who can move only using at least one facility specific to personal protection has a large amount of space for his facility specific to personal protection.

Possibly, the signal state change produced indicates that a user can move only using at least one facility specific to personal protection; and that a user with at least one facility specific to personal protection is transported by at least one elevator cabin from a call input floor directly to a destination floor.

This can mean that the user who can move using at least one facility specific to personal protection is conveyed to the desired destination floor directly and therefore quickly.

Possibly, the change of position by the user is detected when the user positions himself in at least one detection range of the sensor. Possibly, the change of position by the user is detected when the user leaves at least one detection range of the sensor. Possibly, the change of position by the user is detected when the user positions himself close to at least one call input apparatus.

This can mean that the user needs to position himself in the detection range of the sensor. He can position himself inside or outside of the detection range of the sensor and effect a change of position. This bounding of the location at which a change of position by the user is detected as a signal can result in further, even greater clarity for the transmission of the desire by the user to be moved by the elevator system in the handicapped persons mode of operation. Within the context of the present disclosure, close to a call input apparatus then means that the user is positioned less than approximately ten meters, perhaps less than one meter, perhaps a few centimeters, away from the call input apparatus.

Possibly, the change of position by the user is detected by the sensor automatically.

This can mean that the signal can be detected automatically when the user can be detected by the sensor. The user can initiate sensor detection contactlessly, solely by changing position.

Possibly, the detection range of the sensor is less than approximately ten meters, perhaps less than one meter.

This can mean that a sensor with a very reduced detection range can be used to detect the desire by the user to put the elevator system into a handicapped persons mode of operation.

Possibly, the sensor is a motion sensor and/or a load sensor and/or a radio sensor. Possibly, the motion sensor is a camera and/or a photosensor and/or an ultrasonic sensor or an infrared sensor and/or a microphone and/or a noise level sensor. Possibly, the load sensor is a weighing unit. Possibly, the radio sensor is a transmission/reception unit for at least one radio field.

This can mean that it is possible to use a multiplicity of known and proven sensors in order to detect the desire by the user to be moved by the elevator system in the handicapped persons mode of operation.

Possibly, the change of position by the user is detected by at least one motion sensor as a signal; the detected signal is compared with a reference signal detected at a previous time; and if the detected signal does not match the reference signal, the signal state change is produced. Possibly, the change of position by the user is detected by at least one load sensor as a signal; the detected signal is compared with a reference signal detected at a previous time; and if the detected signal does not match the reference signal then the signal state change is produced. Possibly, the change of position by the user is detected by at least one radio sensor as a signal; the detected signal is compared with a reference signal detected at a previous time; and if the detected signal matches the reference signal then the signal state change is produced.

This can mean that the different working of different sensors means that different signal state changes are also produced in order to put the elevator system into the handicapped persons mode of operation.

Possibly, at least one data communication between the radio sensor and at least one mobile communication unit carried by the user is activated within a particular detection range of at least one radio field; and a change of position by the mobile communication unit carried by the user is detected by the radio sensor as at least one signal. Possibly, at least one data communication between the radio sensor and at least one mobile communication unit carried by the user is activated within a particular detection range of at least one radio field; the mobile communication unit sends at least one code to the radio sensor; and the code is detected by the radio sensor as at least one signal. Possibly, the mobile communication unit used is a mobile telephone and/or an RFID card. Possibly, the radio field used is a short-range radio field; the detection range of the short-range radio field is less than approximately ten meters, or less than one meter.

This can mean that merely a change of position by a mobile communication unit in everyday use can be detected as a desire by the user to put the elevator system into a handicapped persons mode of operation. Surprisingly, this is because it is merely possible to use the change of position by the mobile communication unit in order to detect with a high level of certainty the desire by the user to put the elevator system into a handicapped persons mode of operation.

Possibly, at least one data communication between the radio sensor and at least one mobile communication unit carried by the user is activated within a particular detection range of at least one radio field; the mobile communication unit sends at least one code to the radio sensor; the code is detected by the radio sensor as at least one signal; the signal is transmitted from the radio sensor to the destination call controller and/or elevator controller; and the destination call controller and/or elevator controller ascertains at least one call allocation for the transmitted signal.

This can mean that the signal detected by the radio sensor is also accompanied by the transmission of a code for call allocation to the destination call controller and/or elevator controller.

Possibly, the sensor transmits the detected signal to at least one call input apparatus. Possibly, the sensor transmits the detected signal to at least one call input apparatus, which call input apparatus is close to the user whose change of position has been detected as a signal, and at least one input/output unit of the call input apparatus is used to output at least one functional descriptor. Possibly, the sensor transmits the detected signal to at least one call input apparatus, which call input apparatus is close to the user whose change of position has been detected as a signal, and at least one input/output unit of the call input apparatus is used to output a plurality of functional descriptors. Possibly, the sensor transmits the detected signal to at least one call input apparatus, which call input apparatus is close to the user whose change of position has been detected as a signal, and at least one input/output unit of the call input apparatus is used to output a plurality of functional descriptors in at least one predetermined chronology. Possibly, the sensor transmits the detected signal to at least one call input apparatus, which call input apparatus is close to the user whose change of position has been detected as a signal, and at least one input/output unit of the call input apparatus is used to output a plurality of functional descriptors in at least one predetermined order.

This can mean that one or more functional descriptors are output to the user on an input/output unit automatically, without the user having to do anything further, when a signal has been detected and transmitted to the call input apparatus.

Possibly, at least one input/output unit of at least one call input apparatus, which call input apparatus is close to the user whose change of position has been detected as a signal, is used to output at least one functional descriptor to the user when a signal state change has been produced. Possibly, the functional descriptor indicates that the user can move and/or orient himself in the building only using a facility specific to disabled persons. Possibly, the facility specific to disabled persons is a wheelchair and/or a hospital bed on castors and/or a crutch and/or a hearing aid and/or a visual aid and/or a white stick and/or a guide dog and/or an accompanying passenger.

This can mean that a disabled user can indicate which facility specific to disabled persons he intends to use to move and/or orient himself in a building and hence also in the elevator system.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user can move only using a facility specific to personal protection. Possibly, the facility specific to personal protection is a physical safe area and/or a time-based safe area and/or a bodyguard.

This can mean that a user with a potential safety threat can indicate which facility specific to personal protection he intends to use to be moved by the elevator system.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user desires at least one user-specific communication language, the user being able to select between a plurality of communication languages.

This can mean that the user can indicate his preferred communication language.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user desires to make at least one interactive assistance for using the elevator system, the user being able to select between a plurality of assistances.

This can mean that the user is provided with interactive assistance when using the elevator system.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user desires to make at least one destination call, the user being able to select between a plurality of destination floors.

This can mean that the user can confirm between a plurality of destination floors and that a user who has difficulty walking selects that destination floor which he can leave as easily as possible, for example.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user desires to make at least one floor call, the user being able to select between a plurality of starting floors.

This can mean that the user does not necessarily have to begin his journey from the call input floor, but rather can select a starting floor which is convenient to him. By way of example, a user with difficulty walking will select a starting floor which is as easy to reach as possible.

Possibly, at least one input/output unit of at least one call input apparatus, which call input apparatus is close to the user whose change of position has been detected as a signal, is used to output at least one functional descriptor to the user when a signal state change has been produced; and the functional descriptor indicates that the user desires to make at least one cabin call; the user being able to select between a plurality of destination floors.

This can mean that the user in the elevator cabin can make a cabin call of his choice.

Possibly, at least one input/output unit of at least one call input apparatus, which call input apparatus is close to the user whose change of position has been detected as a signal, is used to output at least one functional descriptor to the user when a signal state change has been produced; and that the functional descriptor indicates that the user desires at least one user-specific elevator cabin, the user being able to select between a plurality of elevator cabins.

This can mean that the user can confirm between a plurality of possible elevator cabins in order to get to his destination floor. By way of example, the user wishes a panorama cabin with a nice view or an express cabin for the fastest possible journey.

Possibly, at least one input/output unit of at least one call input apparatus, which call input apparatus is close to the user whose change of position has been detected as a signal, is used to output a plurality of functional descriptors when a signal state change has been produced. Possibly, in the unhandicapped operating state, the sensor detects at least one change of position by the user as a further signal; a comparison is performed to determine whether the further signal matches a recently detected signal, wherein the recently detected signal is the signal or reference signal; if at least one predefined comparison result is achieved then at least one further signal state change is produced; and the call input apparatus marks at least one output functional descriptor for the further signal state change that has been produced. Possibly, in the unhandicapped operating state, the sensor detects at least one change of position by the user as a further signal and a further reference signal; a comparison is performed to determine whether the further signal matches the further reference signal; if at least one predefined comparison result is achieved then at least one further signal state change is produced; and the call input apparatus marks at least one output functional descriptor when the further signal state change has been produced.

This can mean that the user can mark one of a plurality of output functional descriptors contactlessly by means of a simple change of position. Such marking can be hygienic, since the user does not need to touch the call input apparatus and it is therefore less likely for any diseases and/or pathogens to be transmitted.

Possibly, at least one input/output unit of at least one call input apparatus, which call input apparatus is close to the user whose change of position has been detected as a signal, is used to output a plurality of functional descriptors when a signal state change has been produced. Possibly, in the unhandicapped operating state, the sensor detects at least one change of position by the user as yet a further signal; a comparison is performed to determine whether the yet further signal matches a recently detected signal, wherein the recently detected signal is the signal or the reference signal or a further signal or a further reference signal; if at least one predefined comparison result is achieved then at least one yet further signal state change is produced; and the call input apparatus confirms at least one output functional descriptor when the yet further signal state change has been produced. Possibly, in the unhandicapped operating state, the sensor detects at least one change of position by the user as yet a further signal and as yet a further reference signal; a comparison is performed to determine whether the yet further signal matches the yet further reference signal; if at least one predefined comparison result is achieved then at least one yet further signal state change is produced; and the call input apparatus confirms at least one output functional descriptor when the yet further signal state change has been produced.

This can mean that the user can confirm an output functional descriptor contactlessly by means of a simple change of position. Such confirmation can be hygienic, since the user does not need to touch the call input apparatus and it is therefore less likely for diseases and/or pathogens to be transmitted.

Possibly, at least one input/output unit of at least one call input apparatus, which call input apparatus is close to the user whose change of position has been detected as a signal, is used to output a plurality of functional descriptors when a signal state change has been produced; and operation of at least one area of the input/output unit marks at least one output functional descriptor. Possibly, at least one input/output unit of at least one call input apparatus is used to output a plurality of functional descriptors when a signal state change has been produced; and operation of at least one area of the input/output unit confirms at least one output functional descriptor.

This can mean that a user is alternatively also able to activate an output functional descriptor on the input/output unit in order to mark and/or confirm the functional descriptor.

Possibly, the marked and/or confirmed functional descriptor is transmitted from the call input apparatus to the destination call controller and/or elevator controller; and the user is moved by the destination call controller and/or elevator controller for the transmitted functional descriptor using the elevator system in the handicapped persons mode of operation.

This can mean that the user can put an elevator system into a handicapped persons mode of operation totally contactlessly, solely by changing position, and is then moved by the elevator system in the handicapped persons mode of operation.

Further embodiments comprise an elevator system for carrying out a method for catering for the use of the elevator system by handicapped persons. To this end, at least one sensor detects at least one change of position by a user as at least one signal and at least one reference signal; the elevator system compares the signal with the reference signal; and if at least one predefined comparison result is achieved then the elevator system produces at least one signal state change; and the elevator system at least to some extent changes to a handicapped persons mode of operation when the reference state change has been produced.

This can mean that an elevator system is rendered capable of changing from a normal mode to a handicapped persons mode of operation by a signal and a reference signal which have been detected by a sensor as a result of a change of position by a user.

Moreover, the aforementioned object is achieved by proposing a method for upgrading an elevator system having at least one destination call controller and/or elevator controller for carrying out the method for catering for the use of the elevator system by handicapped persons. To this end, at least one sensor is installed for the purpose of detecting at least one change of position by a user as at least one signal and at least one reference signal; at least one signal line and/or radio field for transmitting the signal and reference signal detected by the sensor is installed between the sensor and the elevator system; at least one computer program means is loaded into at least one processor in the elevator system; the computer program means compares the signal with the reference signal; if at least one predefined comparison result is achieved then the computer program means produces at least one signal state change; and the elevator system is at least to some extent put into a handicapped persons mode of operation by the computer program means when the signal state change has been produced.

This can mean that an existing elevator system can be upgraded merely by installing a sensor and a signal line and/or a radio field for the destination call control and/or elevator control in order to allow a user, when a computer program means has been loaded into at least one processor in the destination call controller and/or elevator controller, to generate a signal state change and to put the elevator system into a handicapped persons mode of operation merely by changing positions.

Possibly, a computer program product comprises at least one computer program means which is suitable for implementing the method for catering for the use of an elevator system by handicapped persons by executing at least one method step when the computer program means is loaded into at least one processor in at least one call input apparatus and/or in at least one destination call controller and/or in at least one elevator controller and/or into at least one sensor. Possibly, the computer-readable data memory comprises such a computer program product.

This can mean that an elevator system is rendered capable, by loading the computer program means, of putting the elevator system into a handicapped persons mode of operation when a signal detected by a sensor has been transmitted which, in comparison with a reference signal, results in the production of a signal state change.

BRIEF DESCRIPTION OF THE DRAWINGS

Exemplary embodiments of the disclosed technologies will be explained in detail with reference to the figures, in which, in some cases schematically.

DETAILED DESCRIPTION

Figure 1:
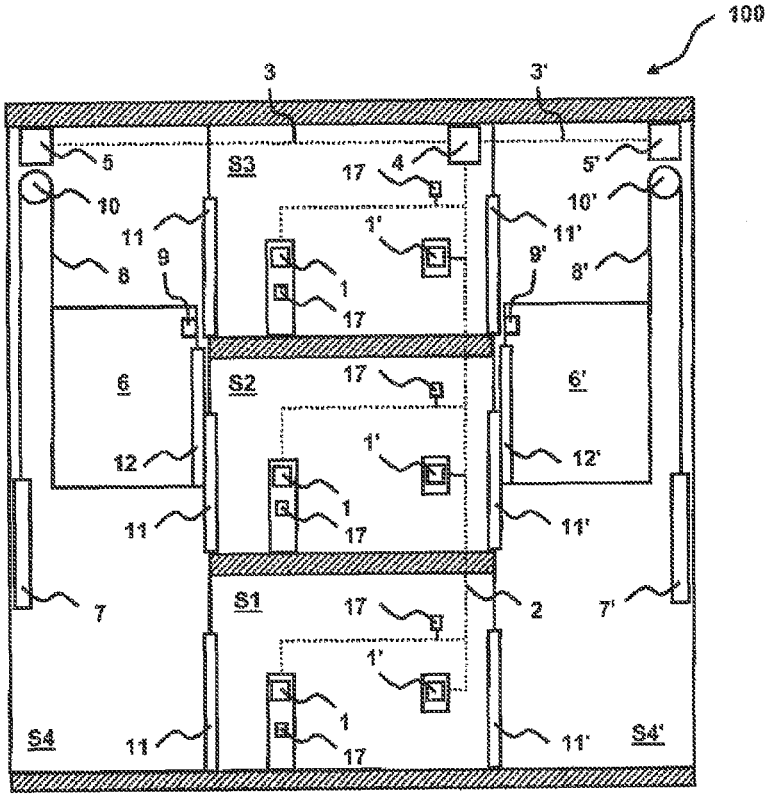
FIG. 1 shows a first exemplary embodiment of an elevator system having a sensor and a call input apparatus as shown in one of FIGS. 3 to 13.
Figure 2:
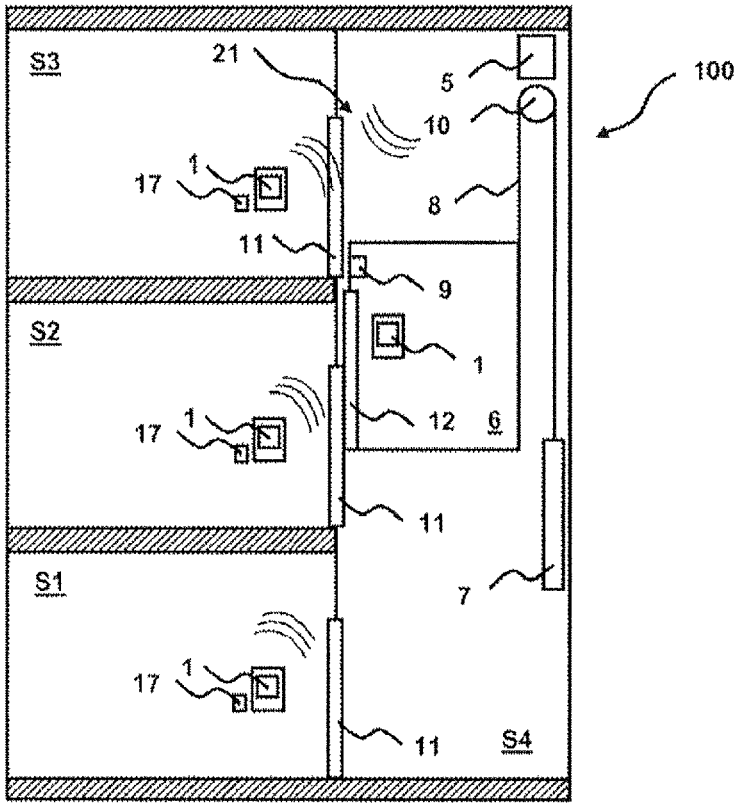
FIG. 2 shows a second exemplary embodiment of an elevator system having a sensor and a call input apparatus as shown in one of FIGS. 3 to 13.

FIGS. 1 and 2 show two exemplary embodiments of an elevator system 100 in a building. The building has a relatively large number of floors S1 to S3 which are served by at least one elevator cabin 6, 6'. On each floor S1 to S3, a user can enter and/or leave the elevator cabin 6, 6' via at least one elevator door 11, 11', 12, 12'. In at least one elevator shaft S4, S4', the elevator cabin 6, 6' is connected to at least one counterweight 7, 7' by means of at least one supporting means 8, 8'. To move the elevator cabin 6, 6' and the counterweight 7, 7', the supporting means 8, 8' is set in motion by at least one elevator drive 10, 10' in frictionally engaged fashion. Normally, at least one door drive 9, 9' is arranged on the elevator cabin 6, 6' and activates the elevator door 11, 11', 12, 12'. In the case of the elevator door 11, 11', 12, 12', a distinction is drawn between a floor door 11, 11' which is arranged on each floor S1 to S3 and a cabin door 12, 12' of the elevator cabin 6, 6'. During a floor stop, the cabin door 12, 12' can be operatively connected to the floor door 11, 11' by means of mechanical coupling such that the cabin door 12, 12' and the floor door 11, 11' are opened and closed simultaneously. FIG. 1 shows two elevator cabins 6, 6' arranged in two elevator shafts S4, S4'. FIG. 2 shows one elevator cabin 6 arranged in one elevator shaft S4. With knowledge of the present disclosure, a person skilled in the art can implement an elevator system 100 having more than three served floors S1 to S3 and/or having more than one elevator cabin 6, 6' per elevator shaft S4, S4' and/or having a hydraulic drive and/or having an elevator drive on the elevator cabin and/or on the counterweight and naturally also an elevator system 100 without a counterweight.

At least one elevator controller 5, 5' in the elevator system 100 has at least one processor and at least one computer-readable data memory. From the computer-readable data memory, at least one computer program means is loaded into the processor and executed. The computer program means actuates the elevator drive 10, 10' and the door drive 9, 9'. At least one housing for the elevator controller 5, 5' contains at least one adapter for at least one radio field 21 and/or at least one adapter for at least one signal line 3, 3' and also at least one electrical power supply.

At least one call input apparatus 1, 1' in the elevator system 100 is arranged close to a floor door 11, 11' and/or in an elevator cabin 6. FIGS. 1 to 13 show a plurality of exemplary embodiments of a call input apparatus 1, 1'. The call input apparatus 1, 1' is mounted on a building wall in the region of the floor door or is located in an isolated fashion in the region of the floor door for floors S1 to S3. At least one housing for the call input apparatus 1, 1' contains at least one adapter for a signal line 2 and/or at least one adapter for at least one radio field 21, at least one input/output unit 13 in the form of a touch screen 13' and/or a keypad 13", at least one tone generator 15 and at least one electrical power supply. The input/output unit 13 comprises a touch screen 13' of rectangular and/or circularly symmetric diameter. By way of example, the touch screen 13' has a diameter of five centimeters and a thickness of between two and ten millimeters. By way of example, the display comprises glass or impact-resistant plastic such as polyurethane, polypropylene, polyethylene, etc. A front side of the touch screen 13' is highly visible to the user and, by way of example, comprises glass or impact-resistant plastic such as polyurethane, polypropylene, polyethylene. Several operating principles for touch screens 13' are known, such as a resistive touch screen, a capacitive touch screen, an optical touch screen, etc., in which touch prompts the alteration of an electromagnetic field or a beam of light. Instead of a touch screen, the input/output unit 13 may also have a simple screen and/or luminous displays. The keypad 13" has a plurality of mechanical keys, which keys have permanently assigned elevator functions. By way of example, the keypad 13" is a decimal keypad for the input of floor descriptors such as "5" or "16". By way of example, the tone generator 15 is a loudspeaker for the output of spoken alphanumeric character strings and/or spoken sentences. The sound pressure of the tone generator 15 can be adjusted in the range between 30 dB and 120 dB, and the frequency band extends from 10 Hz to 25 kHz. The call input apparatus 1, 1' has at least one processor 30 and at least one computer-readable data memory (CRM) 31. From the computer-readable data memory, at least one computer program means is loaded into the processor and executed. The processor of the call input apparatus 1, 1' can have a plurality of computer program means loaded into it which operate independently of one another and/or together with one another. The computer program means actuates the adapter and/or the input/output unit 13 and/or the tone generator 15.

Figure 3:
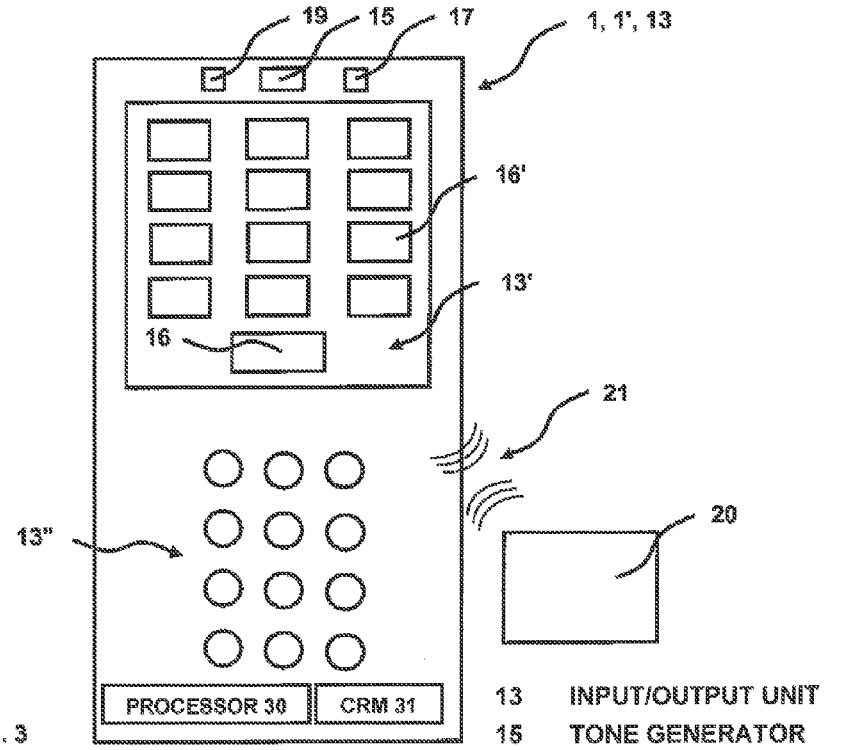
FIG. 3 shows a view of a portion of a first exemplary embodiment of sensors in the form of a radio sensor and of a motion sensor and also of a first exemplary embodiment of a call input apparatus.
Figure 4:
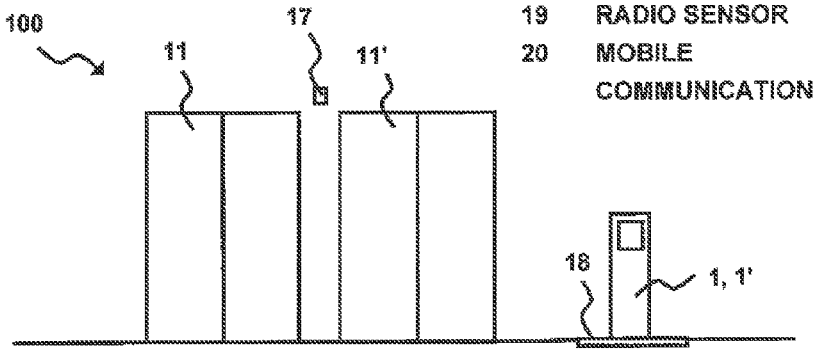
FIG. 4 shows a view of a portion of a second exemplary embodiment of sensors in the form of a motion sensor and of a load sensor and also of a second exemplary embodiment of a call input apparatus.
Figure 5:
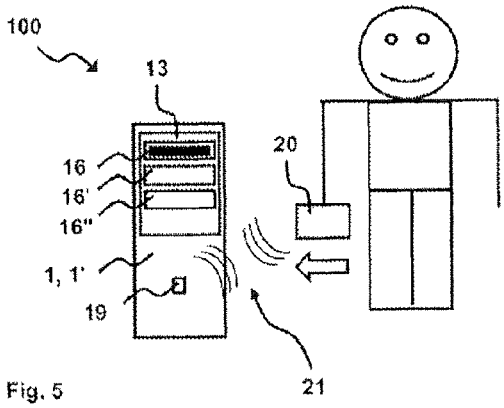
FIG. 5 shows a view of a portion of a third exemplary embodiment of a sensor in the form of a radio sensor and of a third exemplary embodiment of a call input apparatus, wherein a user changes position in order to change the elevator system to a handicapped persons mode of operation.
Figure 6:
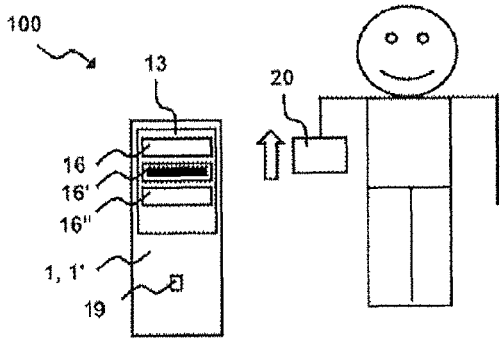
FIG. 6 shows a view of the portion of the third exemplary embodiment of a sensor and of a call input apparatus shown in FIG. 5, wherein a user changes position in order to mark a functional descriptor.
Figure 7:
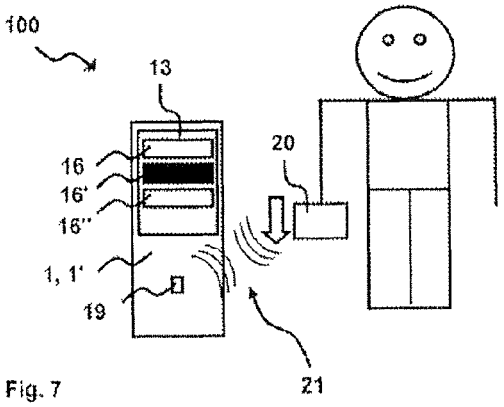
FIG. 7 shows a view of the portion of the third exemplary embodiment of a sensor and of a call input apparatus shown in FIG. 5 or 6, wherein a user changes position in order to confirm a functional descriptor.
Figure 8:
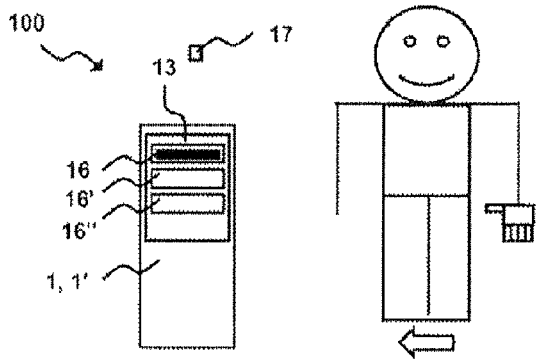
FIG. 8 shows a view of a portion of a fourth exemplary embodiment of a sensor in the form of a motion sensor and a fourth exemplary embodiment of a call input apparatus, wherein a user changes position in order to change the elevator system to a handicapped persons mode of operation.
Figure 9:
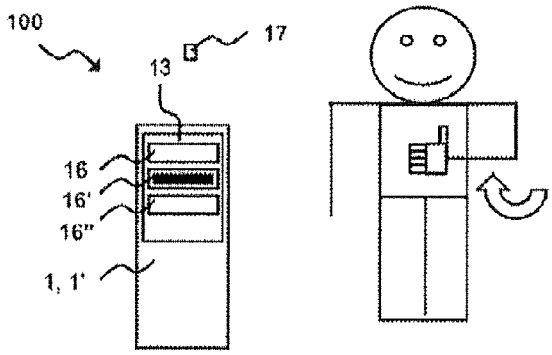
FIG. 9 shows a view of a portion of the fourth exemplary embodiment of sensors and of a call input apparatus shown in FIG. 8, wherein a user changes position in order to mark a functional descriptor.
Figure 10:
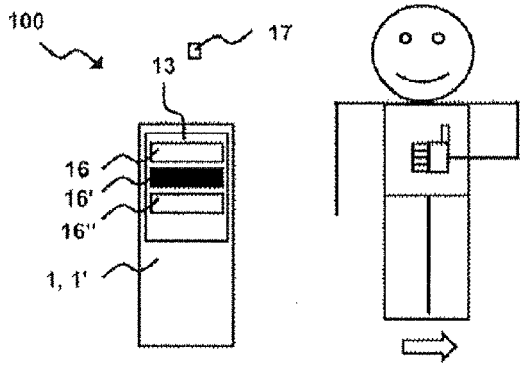
FIG. 10 shows a view of the portion of the fourth exemplary embodiment of sensors and of a call input apparatus shown in FIG. 8 or 9, wherein a user changes position in order to confirm a functional descriptor.
Figure 11:
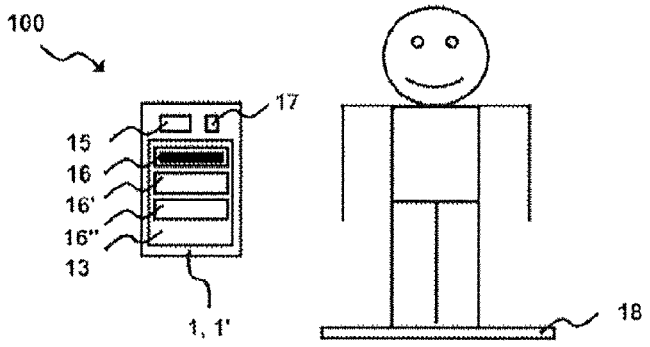
FIG. 11 shows a view of a portion of a fifth exemplary embodiment of sensors in the form of a motion sensor and of a load sensor and also a fifth exemplary embodiment of a call input apparatus, wherein a user changes position in order to change the elevator system to a handicapped persons mode of operation.
Figure 12:
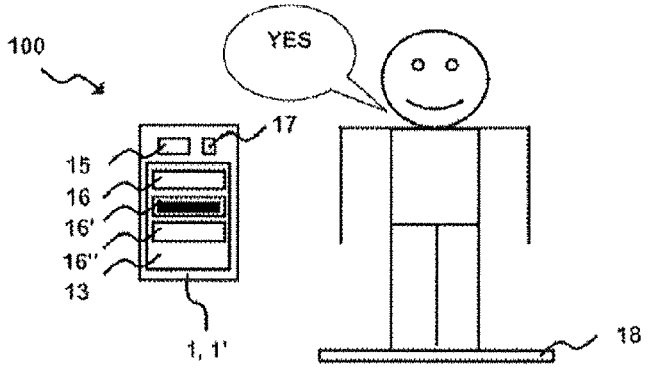
FIG. 12 shows a view of the portion of the fifth exemplary embodiment of sensors and of a call input apparatus as shown in FIG. 11, wherein a user changes position in order to mark a functional descriptor.
Figure 13:
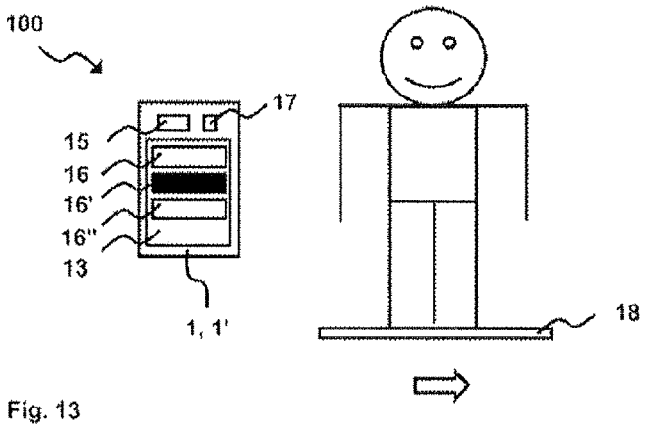
FIG. 13 shows a view of the portion of the fifth exemplary embodiment of sensors and of a call input apparatus as shown in FIGS. 11 or 12, wherein a user changes position in order to confirm a functional descriptor.
Figure 14:
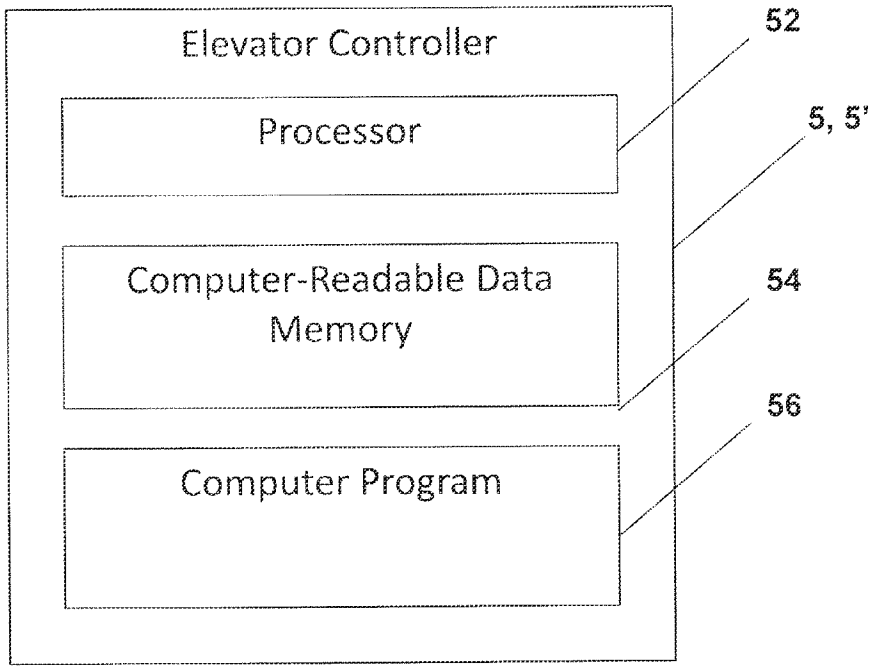
FIG. 14 illustrates and embodiment elevator controller.

At least one sensor 17, 18, 19 in the elevator system 100 detects at least one area of the building. The sensor 17, 18, 19 is arranged in the proximity of a call input apparatus 1, 1'. FIG. 1 shows a first sensor 17 arranged in the housing of a first call input apparatus 1, while a further sensor 17 is arranged above a further call input apparatus 1'. FIG. 2 shows a sensor 17 arranged at the side next to a call input apparatus 1. FIG. 3 shows two sensors 17 and 19 arranged in the housing of a call input apparatus 1, 1'. FIG. 4 shows a first sensor 18 arranged in front of a call input apparatus 1, 1', while a further sensor 17 is arranged above the floor doors 11, 11'. FIGS. 5 to 7 show a first sensor 19 arranged in the housing of a call input apparatus 1, 1'. FIGS. 8 to 10 show a first sensor 17 arranged above a call input apparatus 1, 1'. FIGS. 11 to 13 show a first sensor 17 arranged in the housing of a call input apparatus 1, 1', while a further sensor 18 is arranged in front of the call input apparatus 1, 1'. The sensor 17, 18, 19 is a motion sensor 17 and/or a load sensor 18 and/or a radio sensor 19. The motion sensor 17 is a camera and/or a photosensor and/or an ultrasonic sensor and/or an infrared sensor and/or a microphone and/or a noise level sensor. The load sensor 18 is a weighing unit. The radio sensor 19 is a transmission/reception unit for at least one radio field 21. The sensor 17, 18, 19 has at least one processor, at least one computer-readable data memory, at least one adapter for a signal line 2 and/or at least one adapter for at least one radio field 21 and at least one electrical power supply. From the computer-readable data memory, at least one communication computer program means is loaded into the processor and executed. The communication computer program means controls the communication between the sensor 17, 18, 19 and at least one call input apparatus 1, 1' and/or destination call controller 4 and/or elevator controller 5, 5'. The text below explains embodiments of a sensor 17, 18, 19 by way of example:

The camera has at least one optical lens and at least one digital image sensor. The digital image sensor is a charged coupled device (CCD) sensor or a complementary metal oxide semiconductor (CMOS) sensor, for example. The camera captures images in the spectrum of visible light. The camera can capture still images or moving images at a frequency of 0 to 30 frames per second. From a computer-readable data memory in the camera, at least one computer program means is loaded into a processor in the camera and executed. The computer program means controls the operation of the camera, stores and loads still images, compares still images with one another and can produce at least one signal state change as a comparison result. The camera has an exemplary resolution of two Mpixels and an exemplary sensitivity of two lux. The camera has a motor-operated zoom lens and can thus alter the focal length of the lens automatically or under remote control. It is thus possible to capture objects at different distances in image sections with different levels of detail. The camera has a motor-operated tripod so as to alter the orientation of the lens automatically or under remote control. By way of example, the camera pivots or rotates. The camera is provided with an illumination device and can thus illuminate an object that is to be captured when ambient light is poor or it is dark.

The photosensor operates on the basis of the photoelectric effect and is a photodiode or a phototransistor, for example. The photosensor measures the brightness in the range between 10 lux and 1500 lux, for example, and a resolution of ±one percent.

The ultrasonic sensor operates on the basis of echo time measurement and to this end uses an excited diaphragm, for example. When the ultrasound waves emitted by the diaphragm hit an object, they are reflected and the reflected ultrasound waves are detected. The delay between the emitted ultrasound waves and the detected reflected ultrasound waves is used to ascertain a distance between the diaphragm and the object. The ultrasonic sensor detects movements at an exemplary resolution of one millimeter.

The infrared sensor contactlessly detects radiated heat in an exemplary temperature measurement range between −30° C. and +500° C. at a resolution of ±one percent. The infrared sensor provides thermal images of the radiated heat emitted by passengers.

The microphone is a sound transducer which converts airborne sound into electrical voltage changes. The characteristic sensitivity of the microphone is between five mV/Pa and 100 mV/Pa, for example, and detects a sound pressure level of between 30 dB and 130 dB at an exemplary resolution of one dB.

The noise level sensor detects intensities and noise levels. Intensities are detected at an exemplary resolution of between $10^{-3}$ $\mu Wm^2$ and $10^{+4}$ $\mu Wm^2$; the noise level is detected in an exemplary range of between 30 dB and 110 dB at an exemplary resolution of 0.1 dB.

The weighing unit is a load mat, for example, which detects the weight of a user standing on it in kilograms. Such load mats exist in different dimensions. For example, a load mat has a rectangular base area of 0.5 square meters and a thickness of two centimeters and detects a weight in the range between one kilogram and 200 kilograms.

The transmission/reception unit has at least one processor, at least one computer-readable data memory, at least one adapter for a signal line 2 and at least one electrical power supply. From the computer-readable data memory, at least one communication computer program means is loaded into the processor and executed. The communication computer program means controls the communication between the transmission/reception unit in the radio field 21 and at least one mobile communication unit 20 carried by the user. FIG. 3 shows this communication represented by curved triple circular segments. In this case, a plurality of embodiments are possible:

In a first embodiment, the mobile communication unit 20 is a radiofrequency identification (RFID) card carried by the user, for example, having at least one coil, at least one data memory and at least one processor. The radio frequency used by the transmission/reception unit is 125 kHz, 13.56 MHz, 2.45 GHz, etc., for example. The mobile communication unit 20 uses its coil to inductively receive power from the electromagnetic field of the transmission/reception unit and is thus activated with power. The power activation is effected automatically as soon as the mobile communication unit 20 is in the reception range of the electromagnetic field of between a few centimeters and one meter from the transmission/reception unit. As soon as the mobile communication unit 20 has been activated with power, the processor reads at least one code stored in the data memory, which code is sent via the coil to the transmission/reception unit. The power activation of the mobile communication unit 20 and the sending of the code to the transmission/reception unit are effected contactlessly.

In a second embodiment, the mobile communication unit 20 is a mobile telephone and/or a computer carried by the user, for example. The mobile appliance has at least one processor and at least one computer-readable data memory and at least one electrical power supply. From the computer-readable data memory, at least one communication computer program means is loaded into the processor and executed. The communication computer program means controls the communication of the mobile communication unit 20 in the radio field 21. For the communication in the radio field 21, known local radio networks with a reception range of up to 300 meters such as Bluetooth (IEEE 802.15.1), ZigBee (IEEE 802.15.4) or WiFi (IEEE 802.11), can be used at a frequency of 800/900 MHz or 2.46 GHz, for example. The radio field 21 allows bidirectional communication on the basis of known and proven network protocols such as the Transmission Control Protocol/Internet Protocol (TCP/IP) or Internet Packet Exchange (IPX). As soon as the mobile communication unit 20 is in the radio field 21, the processor reads a code stored in the data memory, which code is sent to the transmission/reception unit.

At least one destination call controller 4 in the elevator system 100 has at least one processor, at least one computer-readable data memory, at least one adapter for a signal line 2 and at least one electrical power supply. According to FIG. 1, the destination call controller 4 is a standalone electronic unit in at least one dedicated housing, which is positioned on floor S3, for example. The destination call controller 4 may also be an electronic plug-in unit, for example in the form of a printed circuit board, which printed circuit board is arranged in the housing of a call input apparatus 1, 1' and/or an elevator controller 5, 5'.

The call input apparatus 1, 1', the sensor 17, 18, 19 and the destination call controller 4 and/or the elevator controller 5, 5' communicate bidirectionally via a signal line 2 such as a Universal Serial Bus (USB), Local Operating Network (LON), Modbus, Ethernet, etc. The signal line 2 is therefore a bus system. This signal line 2 is used to perform a communication on the basis of a known protocol. According to FIG. 1, two respective call input apparatuses 1, 1' and two respective sensors 19 per floor S1 to S3 are communicatively connected to the destination call controller 4 via a signal line 2. The signal line 2 is shown by dotted lines in FIG. 1. Instead of a cabled signal line 2 between the sensor 17, 18, 19 and the destination call controller 4 and/or elevator controller 5, a person skilled in the art can naturally also provide a radio field 21 such as Bluetooth, ZigBee or WiFi. According to FIG. 2, a respective call input apparatus 1 and a sensor 17 per floor S1 to S3 are communicatively connected to an elevator controller 5 via a radio field 21. Each communication subscriber is explicitly identifiable by means of an address for an adapter for the signal line 2 and/or the radio field 21. The radio field 21 is shown by curved triple circular segments in FIG. 2. The destination call controller 4 and the elevator controller 5, 5' communicate bidirectionally via a signal line 3, 3'. According to FIG. 1, the destination call controller 4 is communicatively connected to an elevator controller 5, 5' by means of a respective signal line 3, 3'. The communication subscribers at the ends of the permanently activated signal lines 3, 3' are explicitly identifiable. The signal line 3, 3' is also shown by dotted lines in FIG. 1. Given knowledge of the present disclosure, a person skilled in the art can combine the exemplary embodiments of an elevator system 100 as shown in FIGS. 1 and 2 with one another, for example such that a call input apparatus 1, 1' and/or a sensor 17, 18, 19 is communicatively connected to a plurality of elevator controllers 5, 5' by means of a radio field 21 and/or that a destination call controller 4 is communicatively connected to just one elevator controller 5, 5' by means of a signal line 3, 3'.

The user can make a call by selecting a functional descriptor 16, 16', 16" which is output on the input/output unit 13 of the call input apparatus 1, 1'. The selection can be made by simply marking and/or by confirming a marked functional descriptor 16, 16', 16". According to FIG. 1, the call input apparatus 1, 1' transmits the call which has been made to the destination call controller 4 as a destination call via the signal line 2. According to FIG. 2, the call input apparatus 1 transmits the call which has been made to the elevator controller 5 as a floor call and/or as a cabin call via the radio field 21. As shown in FIGS. 3 and 5 to 10, the user can also send a code from the mobile communication unit 20 to a radio sensor 19 in a call input apparatus 1, 1', which code is received by the radio sensor 19 and transmitted to the destination call controller 4 and/or elevator controller 5, 5'. The code may be a call which is desired by the user and/or may be a user identification, wherein the destination call controller 4 and/or elevator controller 5, 5' associate at least one predefined call with a transmitted user identification, which predefined call is stored in the computer-readable data memory in the destination call controller 4 and/or elevator controller 5, 5'. The code transmitted to the destination call controller 4 and/or elevator controller 5, 5' is therefore handled by the destination call controller 4 and/or elevator controller 5, 5' like a call which has been made.

The call may be a floor call or cabin call or destination call. In the case of a floor call, FIG. 2 shows that first of all an elevator cabin 6 is moved to the floor of the call input apparatus 1, which call input apparatus 1 has been used to make the floor call, or, if the floor call has been transmitted as a code, an elevator cabin 6, 6' is first of all moved to the floor of the radio sensor 19, which radio sensor 19 received the code. This floor is called the call input floor. Only after the user on the call input floor has entered the elevator cabin 6 is—as shown in FIG. 2—a cabin call to a destination floor made on a call input apparatus 1 in the elevator cabin 6, and the elevator cabin 6 moved to this destination floor. This cabin call can also be transmitted to the elevator controller 5, 5' as a code. The elevator controller 5, 5' ascertains at least one respective call association for the floor call and for the cabin call. In the case of a destination call, the call input floor and a destination floor which is desired by the user are denoted, which means that there is no longer a need for a cabin call. Hence, the destination call controller 4 already knows the destination floor and can therefore optimize not only the approach to the call input floor but also the approach to the destination floor. The destination call controller 4 ascertains at least one call association for a destination call. The call association denotes a journey with at least one elevator cabin 6, 6' from a starting floor to a destination floor with the shortest possible waiting time and/or the shortest possible destination time. The starting floor does not have to match the call input floor. The destination floor also does not have to match the destination floor which the user desires on the basis of the destination call. When the call association is assigned to the elevator cabin 6, 6', at least one starting call signal and at least one destination call signal are produced and are transmitted to the adapter for the elevator controller 5, 5' of this elevator cabin 6, 6' via the signal line 3, 3'.

Producing at least one signal state change puts the elevator system into an unhandicapped mode of operation. In the handicapped persons mode of operation, a user is transported by the elevator system 100 unhandicapped in the building. The handicap may be a disability of the user and/or a potential safety threat for the user. In the simplest case, the signal state change indicates in binary fashion whether or not the user is disabled and/or whether or not the user's safety is threatened.

The signal state change can be used to provide a detailed indication of the nature of the disability, such as walking disability, visual disability, hearing disability. The disability may be a physical disability and/or a mental disability. Thus, the user can move and/or orient himself in a building only using at least one facility specific to disabled persons. Examples of a facility specific to disabled persons are a wheelchair, a hospital bed on castors, a crutch, a hearing aid, a visual aid, a white stick, a guide dog, etc. It may also be that a severely disabled user can move only using at least one accompanying user. By way of example, an accompanying user pushes the wheelchair of the severely disabled user or makes a call input for the severely disabled user.

It is also possible to use the signal state change to indicate whether the handicapped user requires passive personal protection and/or active personal protection. For example, the user can move in a building only using at least one facility specific to personal protection. Examples of a facility specific to personal protection are a physical safe area and/or a time-based safe area and/or a bodyguard. By way of example, a physical safe area and/or a time-based safe area with as few other users as possible is/are produced for the handicapped user in the elevator cabin 6, 6'. To this end, other users can be transported by the elevator cabin 6, 6' at earlier and/or later times. It may also be that a user with an acute safety threat is accompanied in the elevator cabin 6, 6' by at least one bodyguard.

Accordingly, in the special mode of operation, the call input apparatus 1, 1' and/or the elevator door 11, 11', 12, 12' and/or the elevator cabin 6, 6' is/are actuated as follows:

- For a user with a facility specific to disabled persons, the elevator door 11, 11', 12, 12' is closed with a particularly long delay and it is closed particularly slowly. Whereas, in the normal mode of operation, an elevator door 11, 11', 12, 12' closes after a delay of between two and twenty seconds and the elevator door 11, 11', 12, 12' requires around two seconds for the closing operation, the delay and the closing operation are between 10% and 50% more for a user with a facility specific to disabled persons.
- For a user with a facility specific to disabled persons, the elevator cabin 6, 6' is stopped with a particular level of precision on floors S1 to S3. Whereas, in the normal mode of operation, the level difference between a floor of the elevator cabin 6, 6' and a threshold of the floor door 11, 11' may be more than ten millimeters, a maximum level difference between the floor of the elevator cabin 6, 6' and the threshold of the floor door 11, 11' of +/− ten millimeters is prescribed pursuant to EN81-70 for a user with a facility specific to disabled persons.
- A user with a facility specific to disabled persons and/or specific to personal protection is allocated a particularly large amount of space in an elevator cabin 6, 6'. Whereas, in the normal mode of operation, an elevator cabin 6, 6' with a 450 kg payload can take up to six users, this elevator cabin 6, 6' with a 450 kg payload is assigned to a single user with a facility specific to disabled persons and/or specific to personal protection. Similarly, an elevator cabin 6, 6' with a 630 kg payload, which can take up to eight users in the normal mode of operation, is assigned one user with a facility specific to disabled persons and an accompanying user and/or one user with a safety threat and a bodyguard.
- A user with a facility specific to disabled persons is transported by the elevator cabin 6, 6' from the call input floor to the destination floor. Whereas the elevator cabin 6, 6' inserts one or more intermediate stops and/or change stops in the normal mode of operation, a user with a facility specific to disabled persons is transported from the call input floor to the desired destination floor, so that he does not have to take any additional routes to reach a starting floor.
- A user with a facility specific to personal protection is transported by the elevator cabin 6, 6' from the call input floor directly to the destination floor. Whereas the elevator cabin 6, 6' inserts one or more intermediate stops and/or change stops in the normal mode of operation, a user with a facility specific to personal protection is transported from the call input floor to the desired destination floor without any intermediate stops and/or change stops.

In order to implement the handicapped persons mode of operation, the user can be provided with at least one functional descriptor 16, 16', 16" which is output via the input/output unit 13 and/or the tone generator 15. The surface of the input/output unit 13 which is visible to the user has at least one functional descriptor 16, 16', 16". The functional descriptors 16, 16', 16" are pictograms and/or alphanumeric character strings. The functional descriptors 16, 16', 16" are produced by at least one luminous element such as a liquid crystal display (LCD), light emitting display (LED) and/or organic light emitting display (OLED), etc. Each luminous element can be activated by the computer program means, and the number, size, color and shape of the functional descriptors 16, 16', 16" are freely programmable. The functional descriptor 16, 16', 16" may also be a "blank area", i.e. a uniform area of the touch screen 13' which currently has no specific characterization. FIG. 3 shows fourteen functional descriptors 16, 16' arranged on the input/output unit 13. FIGS. 5 to 13 show three functional descriptors 16, 16' 16" arranged on the input/output unit 13.

The functional descriptor 16, 16', 16" indicates at least one option of the handicapped persons mode of operation which is executed by the elevator controller 4 and/or the destination call controller 5, 5'. The user is moved for the transmitted functional descriptor 16, 16' 16," with the elevator system 100 in the handicapped persons mode of operation. In this context, a functional descriptor 16, 16', 16" indicates at least one of the following options:

- that the user can move and/or orient himself only using a facility specific to disabled persons; which facility specific to disabled persons is a wheelchair;
- which facility specific to disabled persons is a hospital bed on castors;
- which facility specific to disabled persons is a crutch;
- which facility specific to disabled persons is a hearing aid;
- which facility specific to disabled persons is a visual aid;
- which facility specific to disabled persons is a white stick;
- which facility specific to disabled persons is a guide dog;
- which facility specific to disabled persons is an accompanying passenger;
- that the user can move only using a facility specific to personal protection;
- which facility specific to personal protection is a physical safe area;
- which facility specific to personal protection is a time-based safe area;
- which facility specific to personal protection is a bodyguard;
- that the user desires at least one user-specific communication language, the user being able to confirm between a plurality of communication languages;
- that the user desires at least one interactive assistance for using the elevator system, the user being able to confirm between a plurality of assistances;
- that the user wishes to make at least one destination call, the user being able to confirm between a plurality of destination floors;
- that the user wishes to make at least one floor call, the user being able to confirm between a plurality of starting floors;

that the user wishes to make at least one cabin call, the user being able to confirm between a plurality of destination floors;

that the user desires at least one user-specific elevator cabin 6, 6', the user being able to confirm between a plurality of elevator cabins 6, 6'.

In the handicapped persons mode of operation, functional descriptors 16, 16', 16" are output visually on the input/output unit 13 and are output audibly by the tone generator 15. By way of example, in the handicapped persons mode of operation, a selection between a plurality of destination floors is output visually on the input/output unit 13 as particularly large pictograms and/or alphanumeric character strings such as "1", "2" or "library", "Meier's office" and are voiced with audible clarity and distinctly by the tone generator 15.

The user can mark and/or confirm a descriptor 16, 16', 16" which has been output. The term "mark" is understood to mean selection of one of a plurality of functional descriptors 16, 16', 16". The term "confirm" is understood to mean confirmation of such a selection of a functional descriptor 16, 16', 16". The user can perform this "marking" and "confirmation" in several ways:

By touching the touch screen 13' in the area of a currently output functional descriptor 16, 16', 16", the user operates the input/output unit 13 and can mark and/or confirm a functional descriptor 16, 16', 16" which has been output.

By touching the keypad 13", the user operates the input/output unit 13 and can mark and/or confirm a functional descriptor 16, 16', 16" which has been output.

By detecting a further signal, a functional descriptor 16, 16', 16" is marked. By detecting yet a further signal, a functional descriptor 16, 16', 16" is confirmed. To this end, the user performs at least one further change of position and/or at least yet a further change of position which is detected by the sensor 17, 18, 19 as a further signal and/or as yet a further signal and, as a comparison result, produces a further signal state change and/or yet a further signal state change.

The production of the further signal state change and/or of the yet further signal state change is illustrated by way of example with reference to FIGS. 5 to 13 and described as follows:

In FIG. 5, a user approaches a sensor 19 in the form of a transmission/reception unit, which transmission/reception unit communicates with a mobile communication unit 20 in the right hand of the user in the radio field 21. The transmission/reception unit is arranged in the housing of a call input apparatus 1, 1'. As soon as the user has approached the transmission/reception unit to such an extent that the mobile communication unit 20 is in the detection range of the transmission/reception unit, the mobile communication unit 20 sends a code to the transmission/reception unit. This change of position by the user is denoted by a leftward pointing horizontal arrow. The transmission/reception unit detects the sent code as a signal and transmits it via the signal line 2 shown in FIG. 1 to the destination call controller 4 or via the radio field 21 shown in FIG. 2 to the elevator controller 5. There, the transmitted signal is compared with at least one reference signal. If there is a match, the comparison result produced is a signal state change. The elevator system 100 is to some extent put into an unhandicapped mode of operation for the signal state change. As a result, a plurality of functional descriptors 16, 16', 16" are output to the user on the touch screen 13' schematically in the form of rectangles. The topmost output functional descriptor 16 is premarked by the call input apparatus 1, 1' by virtue of the rectangle being half filled.

In FIG. 6, the user marks one of the output functional descriptors 16, 16', 16". The output functional descriptors 16, 16', 16" are automatically premarked in the order in which they are output while communication is taking place between the transmission/reception unit and the mobile communication unit 20. The call input apparatus 1, 1' first of all premarks the topmost functional descriptor 16, then the second functional descriptor 16' from the top, then the third functional descriptor 16" from the top. The period of time after which the call input apparatus 1, 1' skips from one output functional descriptor 16, 16', 16" to the next is freely settable and is between two and ten seconds, for example. By raising the right hand, the mobile communication unit 20 is taken out of the detection range of the transmission/reception unit and the communication between the transmission/reception unit and the mobile communication unit 20 is interrupted. This change of position by the user is denoted by an upward pointing vertical arrow. The transmission/reception unit detects the termination of communication with the mobile communication unit 20 as a further signal. The further signal from the transmission/reception unit is transmitted to the call input apparatus 1, 1'. There, the transmitted further signal is compared with a reference signal. The reference signal used is the previously detected code of the mobile communication unit 20 in FIG. 5. If the further signal from the transmission/reception unit does not match the reference signal, a further signal state change is produced as a comparison result for the further signal from the transmission/reception unit, and the currently premarked second functional descriptor 16' from the top in FIG. 6 is marked completely for the further signal state change.

In FIG. 7, the user confirms a completely marked functional descriptor 16, 16', 16". By lowering the right hand, the mobile communication unit 20 is taken back into the detection range of the transmission/reception unit and the communication between the transmission/reception unit and the mobile communication unit 20 is set up again. This change of position by the user is denoted by a downward pointing vertical arrow. The transmission/reception unit detects that the communication with the mobile communication unit 20 has been set up again as yet a further signal. The further signal from the transmission/reception unit is transmitted to the call input apparatus 1, 1'. The transmitted yet further signal is compared with a reference signal. The reference signal used is the previously detected code from the mobile communication unit 20 in FIG. 5. If the yet further signal from the transmission/reception unit matches the reference signal, yet a further signal state change is produced as a comparison result for the yet further signal from the transmission/reception unit, and the currently completely marked functional descriptor 16' is confirmed for the yet further signal state change. This confirmation of the second functional descriptor 16' from the top is shown in FIG. 7 by virtue of the rectangle being completely filled.

In FIG. 8, a user approaches a sensor 17 in the form of a camera. This change of position by the user is denoted by a leftward pointing horizontal arrow. The camera is arranged close to a call input apparatus 1, 1' and captures an area in front of the call input apparatus 1, 1'. The camera captures the change of position by the user as still images. The still images are compared with one another in the camera. As soon as the user remains stationary in the capture range of the camera for several seconds, a signal state change is produced. The camera transmits the signal state change via the signal line 2 shown in FIG. 1 to the destination call controller 4 or via the radio field 21 shown in FIG. 2 to the elevator controller 5. The elevator system 100 is to some extent put into an unhandicapped mode of operation for the signal stage change. As a result, a plurality of functional descriptors 16, 16', 16" are output to the user on the touch screen 13' schematically in the form of rectangles. The topmost output functional descriptor 16 is premarked by the call input apparatus 1, 1' by virtue of the rectangle being half filled.

In FIG. 9, the user marks one of the output functional descriptors 16, 16', 16". The output functional descriptors 16, 16', 16" are automatically premarked in the order in which they are output while the user does not change position with his left hand. The call input apparatus 1, 1' first of all premarks the topmost functional descriptor 16, then the second functional descriptor 16' from the top, then the third functional descriptor 16" from the top. The period of time after which the call input apparatus 1, 1' skips from an output functional descriptor 16, 16', 16" to the next is freely settable and is between two and ten seconds, for example. Raising of the left hand of the user is detected in the capture range of the camera as a further signal. This change of position by the user is denoted by an upward pointing curved arrow. The captured still images are compared with one another in the camera. The still image with the raised left hand is compared with the still image in which the user remained stationary in the capture range of the camera, and which produced the prior signal state change, as a reference signal. The nonmatch between the further signal and the reference signal produces a further signal state change as a comparison result. The further signal stage change is transmitted from the camera via the signal line 2 shown in FIG. 1 via the radio field 21 shown in FIG. 2 to the call input apparatus 1, 1', and the currently premarked second functional descriptor 16' from the top shown in FIG. 9 is marked completely for the further signal state change.

In FIG. 10, the user selects a completely marked functional descriptor 16, 16', 16". The user leaves the capture range of the camera, which is detected by the camera as yet a further signal. This change of position by the user is denoted by a rightward pointing horizontal arrow. The captured still images are compared with one another in the camera. The reference signal used is the previously captured still image of the user shown in FIG. 8. If the yet further signal does not match this reference signal, yet a further signal state change is produced for the yet further signal as a comparison result. The yet further signal state change is transmitted from the camera via the signal line 2 shown in FIG. 1 or via the radio field 21 shown in FIG. 2 to the call input apparatus 1, 1', and the currently completely marked functional descriptor 16' is confirmed for the yet further signal state change. This confirmation of the second functional descriptor 16' from the top is shown by virtue of the rectangle being filled completely in FIG. 10.

In FIG. 11, a user approaches a sensor 18 in the form of a weighing unit. This change of position by the user is denoted by a leftward pointing horizontal arrow. The weighing unit is arranged in front of a call input apparatus 1, 1'. As soon as the user steps on to the weighing unit, the weighing unit detects the change of position by the user as a weight and produces a signal therefor. This detected signal is transmitted via the signal line 2 shown in FIG. 1 to the destination call controller 4 or via a radio field 21 shown in FIG. 2 to the elevator controller 5. There, the transmitted signal is compared with a reference signal. As soon as the user remains in the capture range of the weighing unit for several seconds, i.e. is stationary on the weighing unit, a signal state change is produced. The elevator system 100 is to some extent put into an unhandicapped mode of operation for the signal state change. As a result, a plurality of functional descriptors 16, 16', 16" are output to the user on the touch screen 13' schematically in the form of rectangles. The topmost output functional descriptor 16 is premarked by the call input apparatus 1, 1' by virtue of the rectangle being half filled.

In FIG. 12, the user marks one of the output functional descriptors 16, 16', 16". To this end, the call input apparatus 1, 1' has at least one sensor 17 in the form of a microphone. The output functional descriptors 16, 16', 16" are automatically premarked in the order in which they are output while the user does not change position. The call input apparatus 1, 1' first of all premarks the topmost functional descriptor 16, then the second functional descriptor 16' from the top, then the third functional descriptor 16" from the top. The period of time after which the call input apparatus 1, 1' skips from one output functional descriptor 16, 16', 16" to the next is freely settable and is between two and ten seconds, for example. A spoken command from the user such as "YES" is detected in the capture range of the microphone as a further signal. The microphone captures the change of position by the user as airborne sound. This change of position by the user is denoted by a speech bubble. The further signal from the microphone is transmitted to the call input apparatus 1, 1'. There, the transmitted further signal is compared with a reference signal. If the further signal from the microphone matches the reference signal, a further signal state change is produced for the further signal from the microphone as a comparison result, and the currently premarked second functional descriptor 16' from the top in FIG. 12 is marked completely for the further signal state change.

In FIG. 13, the user selects a completely marked functional descriptor 16, 16', 16". The user leaves the capture range of the weighing unit, which is detected by the weighing unit as yet a further signal. This change of position by the user is denoted by a rightward pointing horizontal arrow. The yet further signal from the weighing unit is transmitted to the call input apparatus 1, 1'. There, the transmitted yet further signal is compared with a reference signal. The reference signal used is the previously detected weight of the user in FIG. 11. If the yet further signal from the weighing unit does not match the reference signal, yet a further signal state change is produced for the yet further signal from the weighing unit as a comparison result, and the currently completely marked functional descriptor 16' is confirmed for the yet further signal state change. This confirmation of the second functional descriptor 16' from the top is shown by virtue of the rectangle being filled completely in FIG. 13.

Given knowledge of the present disclosure, a person skilled in the art has diverse options for varying the method steps shown, which variations cannot all be shown purely for economic reasons. Thus, confirmation of a functional descriptor 16, 16', 16" can be practical but is not absolutely necessary in order to carry out the method for catering for the use of the elevator system 100 by handicapped persons. In principle, marking of a functional descriptor 16, 16', 16" is sufficient. The call input apparatus 1, 1' transmits the marked and/or confirmed functional descriptor 16, 16', 16" via the signal line 2 shown in FIG. 1 to the destination call controller 4 or via a radio field 21 shown in FIG. 2 to the elevator controller 5. There, the option linked to the functional descriptor 16, 16', 16" is executed. It is also possible for a functional descriptor 16, 16', 16" to be marked and confirmed coincidentally in one method step. It is thus possible to produce both a further signal state change and yet a further signal state change by leaving the capture range of the camera shown in FIG. 10 or by leaving the capture range of the weighing unit shown in FIG. 13. In this case, the method step of raising the left hand shown in FIG. 9 or the method step of the spoken command shown in FIG. 12 is not necessary. The user thus merely needs to enter the capture range of the camera or of the weighing unit for several seconds and then leave it again in order to carry out the method for catering for the use of the elevator system 100 by handicapped persons.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. An elevator operation method, comprising:

detecting, using a sensor, a position change by an elevator user, the detecting being based on first and second detected signals;

comparing the detected position change with one or more predefined position changes; and as a result of the comparison, placing an elevator call input device into a handicapped user mode.

2. The elevator operation method of claim 1, wherein the first or second detected signal is detected when the user enters a detection range of the sensor or when the user leaves the detection range of the sensor.

3. The elevator operation method of claim 1, wherein the first and second detected signals are detected at the elevator call input device.

4. The elevator operation method of claim 1, wherein the detected position change indicates at least one handicapped aid is used by the user.

5. The elevator operation method of claim 1, wherein the detected position change indicates that at least one personal protection facility is used by the user.

6. The elevator operation method of claim 1, further comprising generating a destination call control signal.

7. The elevator operation method of claim 1, further comprising:

receiving a destination call from the user using the elevator call input device; and placing the elevator call input device out of the handicapped user mode.

8. The elevator operation method of claim 1, further comprising:

detecting a further position change by the user; and as a result of the further position change, outputting one or more functional descriptors using the elevator call input device.

9. An elevator installation comprising:

an elevator cabin;

at least one sensor configured to detect a passenger outside of the elevator cabin;

an elevator call input device, wherein the elevator call input device is configured to be placed into a handicapped user mode based at least in part on passenger movement detected by the at least one sensor.

10. The elevator installation of claim 9, wherein the at least one sensor has a range of about one meter.

11. The elevator installation of claim 9, wherein the at least one sensor has a range of about ten meters.

12. The elevator installation of claim 9, wherein the user movement comprises a movement of an appendage of the passenger.

13. One or more non-transitory computer-readable storage media having encoded thereon instructions that, when executed by a computer, cause the computer to perform a method, the method comprising:

detecting, using a sensor, a movement by an elevator user;

comparing the detected movement with one or more predefined movements; and as a result of the comparison, placing an elevator call input device into a disabled user mode.

14. The one or more non-transitory computer-readable storage media of claim 13, wherein the sensor detects the movement of a card held by the elevator user.

15. The one or more non-transitory computer-readable storage media of claim 13, wherein the movement comprises a gesture.

16. The one or more non-transitory computer-readable storage media of claim 13, wherein the sensor is positioned on the elevator call input device.

17. An elevator system component comprising:

a processor;

an input/output unit coupled to the processor; and one or more computer-readable media coupled to the processor, wherein the one or more computer-readable media store instructions which, when executed by the processor, cause the processor to, detect, using received sensor data, at least one position change by an elevator user, and as a result of the detecting, place the elevator system component into a handicapped user mode.

18. The elevator system component of claim 17, wherein the instructions further cause the processor to detect a destination call based at least in part on a further detected position change by the elevator user.

19. The elevator system component of claim 17, wherein the input/output unit comprises a display, and wherein the instructions further cause the processor to display one or more functional descriptors on the display.

20. The elevator system component of claim 17, wherein the detected at least one position change is detected relative to a position of the elevator system component.

21. An elevator operation method, comprising:

detecting, using a sensor, a position change by an elevator user, the detecting being based on first and second detected signals;

comparing the detected position change received from the sensor, with one or more predefined position changes; and as a result of the comparison, changing a mode of the elevator call input device into a handicapped user mode and transmitting, by the elevator call input device, a signal state change to at least one of an elevator controller or destination controller.

22. The elevator operation method of claim 21, further comprising:

receiving a destination call from the user using the elevator call input device; and changing the mode of the elevator call input device out of the handicapped user mode.

23. The elevator operation method of claim 21, further comprising:

detecting a further position change by the user; and as a result of the further position change, outputting one or more functional descriptors using the elevator call input device.

24. The elevator operation method of claim 21, wherein said placing step further comprises placing the elevator call input device into the handicapped user mode comprising at least one option for selection or display to the elevator user relating to a handicap characteristic of the elevator user.

25. The elevator operation method of claim 1, wherein said placing step further comprises placing the elevator call input device into the handicapped user mode comprising at least one option for selection or display to the elevator user in addition to or instead of a user selection of a floor option.

26. The elevator operation method of claim 1, wherein said placing step further comprises placing the elevator call input device into the handicapped user mode comprising a plurality of options presented to the elevator user responsive to said comparing.

27. The elevator operation method of claim 1, wherein said placing step further comprises placing the elevator call input device into the handicapped user mode comprising at least one option for selection or display to the elevator user relating to a handicap characteristic of the elevator user.

* * * * *